US005929396A

United States Patent [19]

Awad

[11] Patent Number: 5,929,396

[45] Date of Patent: Jul. 27, 1999

[54] NOISE REDUCING DIFFUSER

[76] Inventor: Elias A. Awad, 4301 Via Pinzon, Palos Verdes, Calif. 90274

[21] Appl. No.: 08/902,418

[22] Filed: Jul. 29, 1997

[51] Int. Cl.[6] ..... F01N 1/00

[52] U.S. Cl. ..... 181/211; 181/224; 181/233

[58] Field of Search ..... 181/211, 213, 181/215, 224, 233, 247, 248

[56] References Cited

U.S. PATENT DOCUMENTS

| | | | |
|---|---|---|---|
| 2,820,406 | 1/1958 | Argentieri . | |
| 3,061,039 | 10/1962 | Peters . | |
| 3,568,791 | 3/1971 | Luxton | 181/224 |
| 3,695,388 | 10/1972 | Paxhia et al. | 181/213 |
| 4,244,440 | 1/1981 | Matta et al. | 181/213 |
| 4,298,088 | 11/1981 | Keller . | |
| 4,418,788 | 12/1983 | Gorchev et al. . | |
| 4,872,398 | 10/1989 | Shen . | |

OTHER PUBLICATIONS

The Lee Company Technical Hydraulic Handbook, Axial Visco Jet, pp. 32 & 33, Lee Bender Jet, pp. 58 & 59.

*Primary Examiner*—Khanh Dang
*Attorney, Agent, or Firm*—Christie, Parker & Hale, LLP

[57] ABSTRACT

A noise reducing diffuser which reduces the sound energy created by a pressurized gas while it is being expelled through a nozzle. The diffuser consists of an elongated enclosure with openings at each end that is attached to the output of the gas nozzle. The dimensions of the enclosure, particularly its distance from the sound source, effective diameter and length, are chosen to specifically eliminate audible noise created by the escaping gas by conversion of a portion of the longitudinal component of the sound energy to an increased radial component that can then be dissipated by repeated contact with the wall of the elongated enclosure.

11 Claims, 4 Drawing Sheets

Fig. 1
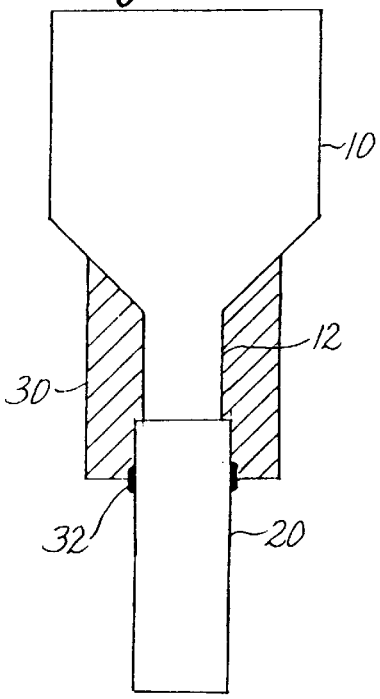
Fig. 2
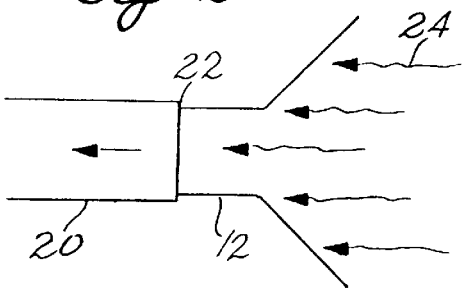
Fig. 3
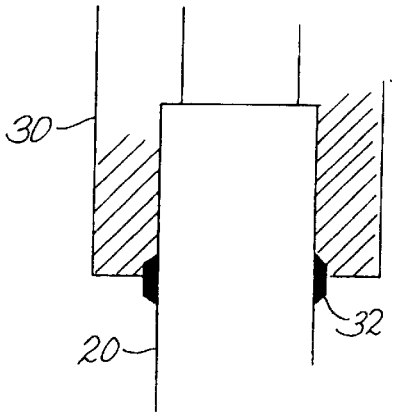
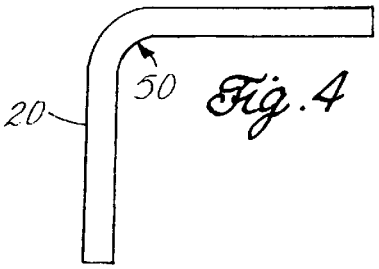
Fig. 4
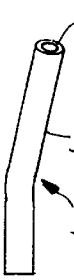
Fig. 5
Fig. 6
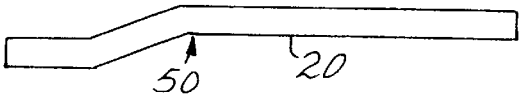

NOISE REDUCING DIFFUSER

FIELD OF THE INVENTION

The present invention concerns a device and technique for reducing the audible noise created by a source, such as a gas after it travels through a nozzle of a gas distribution system.

BACKGROUND OF THE INVENTION

In enclosed environments, whether underground, under water, at high altitude, or even in outer space, gas distribution systems often consist of a pressurized tank of gas that is released to the ambient environment through a small output nozzle. The nozzle can have a diameter of less than one twentieth of one inch. Flow of the gas, e.g., Nitrogen or Oxygen, can be driven by an internal pressure inside the tank of 100 pounds per square inch (psi) or more while exiting to an external pressure around atmospheric pressure, between 0 and about 14.7 psi. This pressure difference will create a supersonic flow and cause a shockwave breakdown, which creates a whistling sound as the gas leaves the nozzle. In the range most potentially audible to human ears, 65–8000 Hz, this sound can reach a volume of 80 dB or more.

Such a noise level is distracting to anyone near the nozzle. Moreover, if not reduced at the source, the noise can be transmitted great distances to annoy others in the enclosed environment. Thus, efforts have been made to reduce the noise levels associated with a gas distribution system at or within a short distance from the noise sources in the system. Such efforts have not been entirely successful.

Previous systems have employed techniques such as mufflers, where baffles extend into the path of the sound waves, in an effort to reduce noise. Upon contact with the baffles, the sound waves lose some of their energy, which the baffles dissipate through vibrating. However, the exchange of energy with baffles is not very efficient; it is difficult to position baffles so that they will be able to help absorb sound energy in all directions; and it is also difficult to vary the sizes of the baffles so that they can interact effectively with sound energy across the broad range of audible frequencies. Thus, mufflers have not been that effective at reducing noise, particularly at the higher frequency end of the audible range, about 1250–8000 Hz which, unfortunately, is the portion of the range that is most annoying to the human ear.

Accordingly, a need has existed for reducing sound energy more effectively and immediately at noise sources such as those that are typically found in gas distribution systems.

SUMMARY OF THE INVENTION

A sound wave traveling from a source, such as a gas distribution nozzle, has longitudinal, radial (transverse) and tangential components. The present invention reduces the noise associated with such a sound wave by forcing much of the sound energy created by the shockwave into the radial component, which can then be dissipated as heat energy through multiple contacts with the wall of an enclosure.

When a sound wave travels through an enclosure, that enclosure needs to have an effective diameter of at least one fourth of the wavelength ($\lambda/4$) or the wave will be distorted. The present invention directs the sound wave created downstream of a source, such as a gas nozzle, into an enclosure that has an effective diameter less than $\lambda/4$, preferably much less than $\lambda/4$, thereby distorting it and forcing it to reconfigure. Furthermore, the enclosure must start at a distance no more than $\lambda/4$ from the sound source. The reconfigured sound wave has a decreased longitudinal component and an increased radial component whereby it repeatedly strikes the inside of the enclosure before the far end of the enclosure is reached, heating the inner surface of the wall of the enclosure and thereby losing much of its energy before exiting the enclosure.

Accordingly, the present invention provides a device for reducing to acceptable levels the human audible sound wave energy emanating from a source. The device comprises an elongated enclosure positioned to receive the sound wave energy and adapted to translate a portion of a longitudinal component of the sound wave energy into an increased radial component of the sound wave energy, and a wall for the elongated enclosure adapted to absorb a portion of the radial component of the sound wave energy.

In a particularly preferred application of the present invention, the diffuser can be placed just downstream (within one one quarter of the wavelength of the sound wave to be minimized) of a gas nozzle to minimize the sound energy created by an escaping gas. The diameter of the diffuser is smaller than one quarter of the wavelength of the sound wave to be minimized. The diffuser can be angled or bent to improve sound minimization, or can be shaped so that multiple gas nozzles share the same diffuser.

The present invention also provides a method for absorbing some of the sound wave energy from a source. The method involves translating a portion of a longitudinal component of the sound wave energy into an increased radial component of the sound wave energy. It then involves positioning a surface so that it is able to interact with the radial component of the sound wave energy to dissipate at least some of that component of the energy.

BRIEF DESCRIPTION OF THE DRAWINGS

FIG. 1 is a schematic cross sectional view of a tank, nozzle and noise reducing diffuser according to the present invention.

FIG. 2 is a schematic cross sectional view of gas flowing out of the end of the tank, through the nozzle and into the attached noise reducing diffuser.

FIG. 3 is an enlarged cross sectional view of the nozzle and diffuser.

FIG. 4 is a side view of a bent or angled diffuser according to an alternate embodiment of the present invention.

FIG. 5 is a front view of the bent diffuser of FIG. 4.

FIG. 6 is a side view of a diffuser with two obtuse bends according to another alternate embodiment of the present invention.

DETAILED DESCRIPTION OF THE INVENTION

Figure 7:
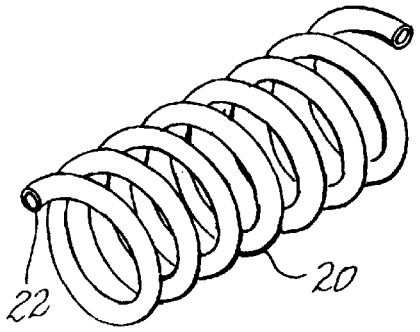
FIG. 7 is a perspective view of a diffuser in a spiral or coiled formation according to a further alternate embodiment of the present invention.

The present invention can be used to reduce the noise or other disruptions associated with many sources of sound wave energy. However, a particularly preferred application of the present invention is to reduce the noise associated with gas distribution through a nozzle.

FIG.1 shows a typical gas housing with a tank 10 able to hold gases such as Nitrogen or Oxygen under pressure. Pressurized gas is allowed to flow out of the tank through a nozzle 12. A diffuser 20 representing a preferred embodiment of the present invention is attached to the nozzle just downstream (within one quarter of the wavelength of the sound wave to be minimized) from its exit. In this embodiment, the diffuser is in the form of an elongated cylindrical tube oriented so that it extends outward from the nozzle exit in a direction roughly parallel to the bulk flow direction of the gas leaving the nozzle. Both ends of the diffuser are open to allow gas flow through the diffuser.

As shown in FIG. 2, the one end 22 or mouth of the diffuser immediately adjacent the nozzle exit is slightly wider than the narrowest diameter of the nozzle. The effective diameter of the diffuser should normally be wider than that of the nozzle so that the nozzle still controls the gas flow rate and remains the source of any noise due to shockwave breakdown. The position of the mouth of the diffuser insures that the entirety of a sound wave generated by the escaping gas is directed into the diffuser. To insure that the sound wave is so directed, the mouth of the diffuser should be positioned so as to be not farther than $\lambda/4$ from the nozzle where the sound is generated. Placing the diffuser immediately adjacent to the nozzle is presently preferred.

In a preferred embodiment, the diffuser is attached to the nozzle as shown in FIG. 3. The diffuser is brazed to an encasing material 30, which holds the diffuser in place. As shown in FIG. 3, brazing 32 is on the outside of the enclosure 20. Attaching the diffuser in this way insures that the brazing does not interfere with the mass flow rate of the escaping gas. Although brazing is presently preferred, any method providing a secure attachment and not interfering with gas flow should be acceptable. In an alternate embodiment the diffuser can be incorporated as an integral part of the nozzle itself, forming one connected unit. The shockwave breakdown will still occur where the gas moves from the high tank pressure to the low ambient pressure, so a single nozzle-diffuser unit conforming to the proper width and length requirements will reduce sound levels according to the present invention.

The width of the diffuser is subject to a variety of considerations. The diffuser must be wide enough so that it captures the entire sound wave created at the nozzle and does not interfere with the mass flow rate of the gas. Yet, it must also have an effective diameter small enough to achieve sufficient sound loss. The effective diameter should be less than $\lambda/4$ to cause reconfiguration of the sound waves and is preferably much less than $\lambda/4$ to cause enough reconfiguration to produce an acceptable noise reduction.

A sound wave has a longitudinal component, a radial component and a tangential component. The longitudinal component is the portion of the wave that propagates in the same direction as the flow is traveling. Here that longitudinal propagation direction is down the length of the tube. The radial component propagates at a direction perpendicular to the direction the flow is traveling. Here that transverse propagation direction is radially outward from the center of the diffuser toward the wall of the diffuser.

When a sound wave travels through a diffuser with an effective diameter smaller than ¼ of the sound's wavelength some of its longitudinal energy is "cut-off" by the narrow diameter and translated into radial wave energy. As the radial waves propagate through the diffuser they collide with the inner walls and convert to heat, thereby lowering the total energy (and volume) of the sound wave.

In an embodiment where the nozzle has a diameter of 0.032 inch, an acceptable tradeoff between sound reduction and uninterrupted flow rate has been yielded by a diffuser with a diameter of 0.052 inch. It is anticipated that in most applications, an acceptable effective diameter for the diffuser will be between 125% to 175% wider than the nozzle with which it is associated. It is also anticipated that an effective diameter for the diffuser that is about 150% wider than the nozzle will be most preferred. The effective diameter of the diffuser can be changed depending on the frequency range of sound energy that needs to be silenced and the application in which the diffuser is to be used.

The length of the diffuser is also subject to a variety of considerations. The diffuser needs to be long enough to allow for sufficient sound reduction but should not be so long that it interferes with anything around it. In the embodiment where the nozzle has a diameter of 0.032 inch, the diffuser needs to be only about 1 inch long to achieve useful reduction in sound level, but the preferred length is between about 2 and 6 inches, with 3 inches being most preferred at the present time. The maximum length of the diffuser is limited mainly by external considerations such as space and cost.

The diffuser can be made of any material with sufficient sound absorption qualities. The presently preferred embodiment uses a diffuser made of 347 Austenitic Stainless Steel. However, different materials can be used for different sound absorption properties or for different environments. For example, if less sound absorption is needed, the diffuser can be made of aluminum; if more is needed, titanium. If the gas being expelled is highly corrosive, the diffuser can be manufactured from a resistant material such as an Inconel alloy.

The energy absorption involved should be such that any heating of the inside surface of the diffuser will be minor and limited to a surface phenomenon. Thus, the material of the diffuser need not be heat resistant in most applications and the wall thickness of the diffuser is not an issue except for external structural concerns. Also, the diffuser need not be insulated in most applications unless external temperature impacts upon the gas are a concern.

The diffuser can be manufactured as a seamless straight tube in any conventional manner as pictured in FIG. 1, however adding bends, angles or curves 50 increases the loss of sound energy. FIGS. 4–7 show different potential configurations for the diffuser. Furthermore, the enclosure does not have to be a cylindrical tube. It can be of any practical exterior shape and of any practical interior shape so long as the interior effective diameter is small enough to perform the required sound manipulation.

Figure 8:
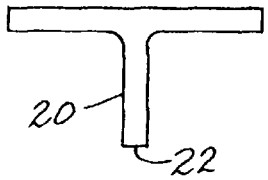
FIG. 8 is a diffuser according to the present invention used to input gas from two sources and output it through the same enclosure.
Figure 9:
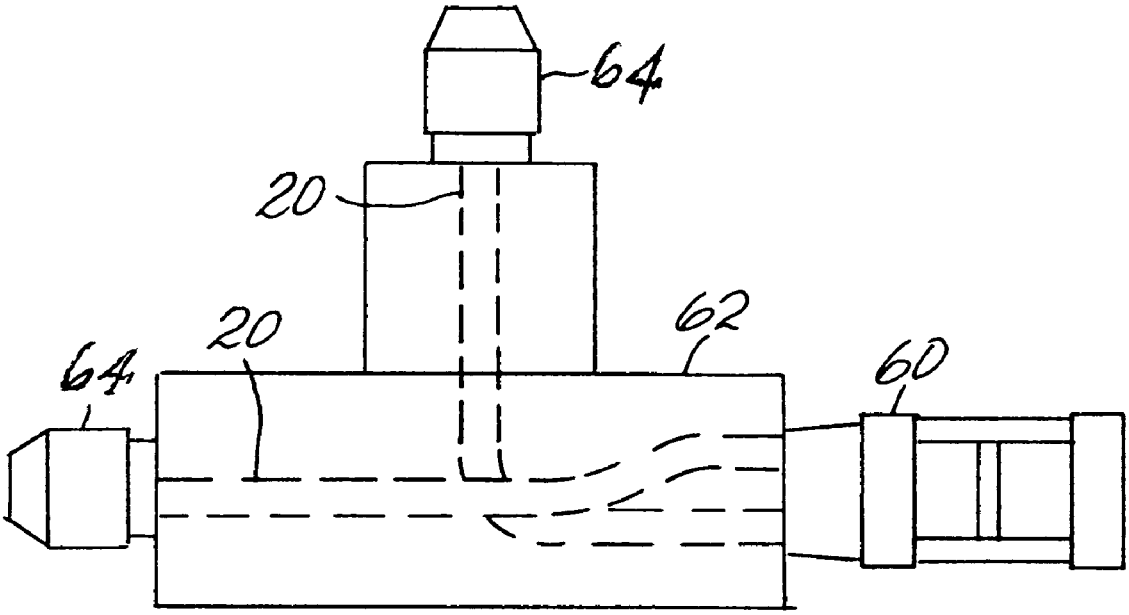
FIG. 9 is a perspective view of a gas distribution system using two diffusers of the present invention.

FIG. 9 shows two diffusers of the present invention in use with a gas distribution system. Each diffuser 20 is connected to a nozzle (not shown), each nozzle associated with a separate gas tank through connectors 64. The diffusers are protected by a housing 62 to prevent them from being damaged. Both diffusers output through the same exhaust fitting 60. Alternatively, the diffuser can be shaped so that it connects to multiple nozzles, accepts gas inputs and removes sound produced by each nozzle and then outputs the gas mixture through one opening 22 (see FIG. 8). In another configuration multiple diffusers can be combined in parallel to handle systems that require both low noise and a large mass flow rate.

Figure 10:
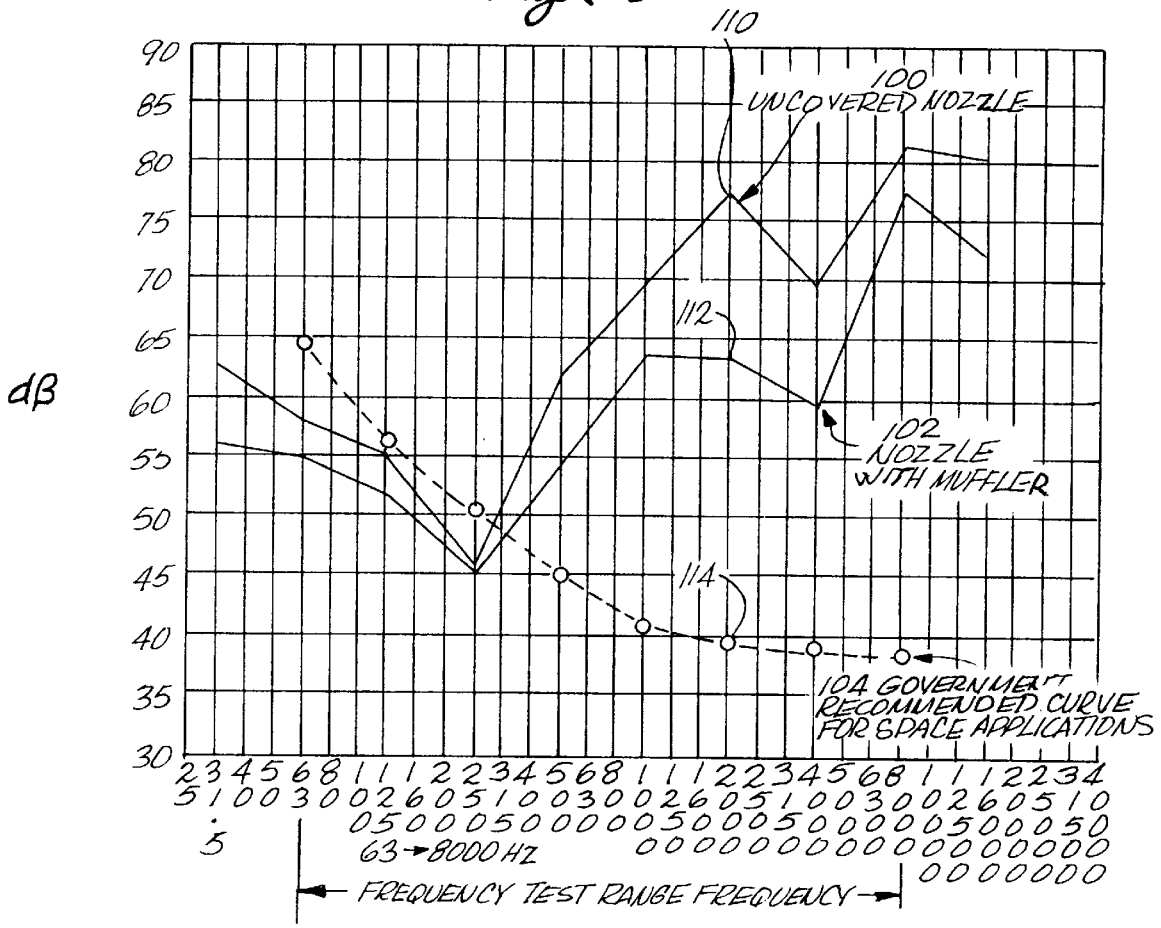
FIG. 10 is a graph showing the sound level from an uncovered nozzle of a gas diffuser and another graph showing the sound level from the same type of nozzle with a muffler.

FIG. 10 is a graph of the external sound level (measured in decibels, dB) from a gas escaping from an uncovered nozzle 100, the external sound level from a gas escaping from the same type of nozzle with a muffler 102 and the Government recommended maximum sound level curve for space applications 104. The Government recommendations are referred to as NC-40 and are based upon the fact that sound levels below 40 dB are imperceptible to most persons. In each of the examples graphed in FIG. 10, the gas was being released to atmospheric pressure from a pressure of about 100 psi through a 0.032 inch diameter nozzle. In both examples, sound levels were measured at well above acceptable levels in the most annoying portion of the audible range. A conventional muffler did little to reduce the sound levels in that portion of the range to acceptable levels.

Figure 11:
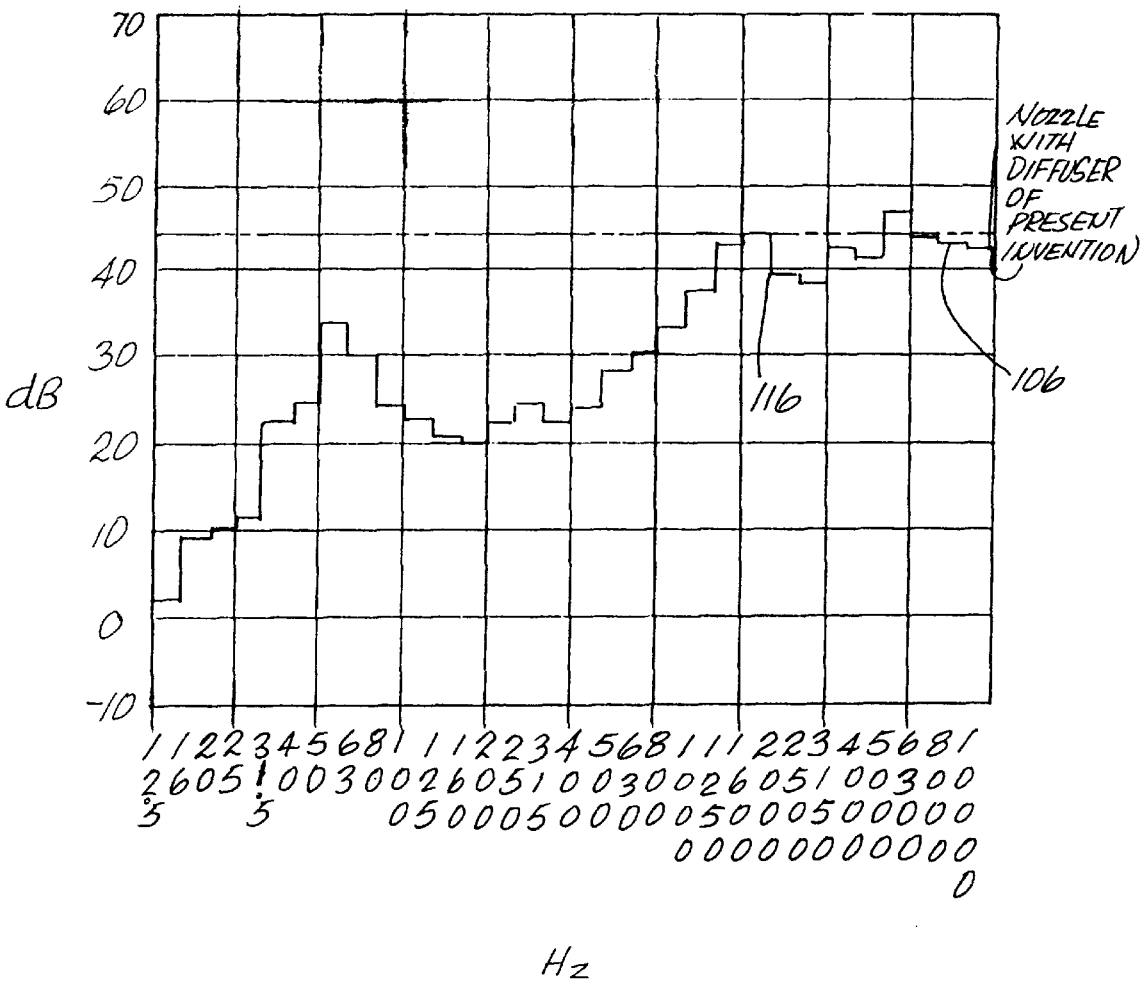
FIG. 11 is a graph demonstrating the performance of a diffuser according to a test configuration of the present invention when attached to the same type of nozzle as used to develop the graphs of FIG. 10.

FIG. 11 is a graph of the external sound level (measured in dB) from a gas escaping from the same type of nozzle as was used to generate the graphs of FIG. 10 but with a diffuser according to the present invention 106. Again, the gas was being released to atmospheric pressure from about 100 psi through a 0.032 inch diameter nozzle. The diffuser was a cylindrical tube with two bends, 0.052 inch in diameter and 3 inches in length. The nozzle with the diffuser of the present invention yields an external sound level much lower than that yielded by either the uncovered nozzle or the nozzle with the muffler. Note that at 2000 Hz the uncovered nozzle yields a sound level at around 76 dB 110 (FIG. 10). When a diffuser according to the present invention is added, the sound level at 2000 Hz drops to around 40 dB 116 (FIG. 11). Because dB is a logarithmic scale, a sound with a sound level 36 dB lower than a first sound has an actual intensity 64 times lower than the first sound.

The applications for the present invention are not limited to any particular industry. Any application that involves the controlled release of a gas can benefit from diffusers that utilize the invention described above. Hospitals and manufacturing facilities could use the diffuser singly to reduce the noise from individual pressurized gas nozzles or in combination to handle larger gas distribution processes. The aerospace, automotive or airline industry could use the diffusers to reduce the noise from cabin air distribution systems. The noise generated by engine exhaust gases may even be minimized through use of the present invention.

Although limited embodiments of sound reducing diffusers of this invention have been described and illustrated herein, many modifications and variations will be apparent to those skilled in the art. Accordingly, it is to be understood that within the scope of the appended claims, sound diffusers of this invention may be embodied other than as specifically described herein.

I claim:

1. A diffuser for reducing the noise associated with gas being distributed through a nozzle, the diffuser comprising:

an elongated enclosure, having at least one open input end adapted to be located just downstream of the nozzle and at least one open output end through which gas entering the input end can exit;

the enclosure having an effective diameter less than one-quarter of the wavelength of any of the human audible sound waves generated by the gas being distributed through the nozzle; and the one open input end being positioned a distance from the nozzle less than one-quarter of the wavelength of any of the human audible sound waves generated by the gas being distributed through the nozzle.

2. The diffuser of claim 1 where the effective diameter of the enclosure is between about 125–175% of the diameter of the nozzle.

3. The diffuser of claim 1 where the effective diameter of the enclosure is about 150% of the diameter of the nozzle.

4. The diffuser of claim 1 where the length of the enclosure is greater than about 1 inch.

5. The diffuser of claim 1 where the length of the enclosure is between about 2 and 6 inches.

6. The diffuser of claim 1 where the length of the enclosure is about 3 inches.

7. The diffuser of claim 1 where the open input end is placed directly adjacent to the nozzle.

8. The diffuser of claim 1 where the enclosure is a cylindrical tube.

9. The diffuser of claim 1 where the enclosure is manufactured from 347 Austenitic Stainless Steel.

10. A method for absorbing some of the sound wave energy emanating from a source, the method comprising the steps of:

translating at least a portion of a longitudinal component of the sound wave energy into an increased radial component of the sound wave energy; and positioning a surface so that it is able to interact with the increased radial component of the sound wave energy to dissipate at least some of that component of the energy.

11. A device for reducing to acceptable levels the human audible sound wave energy emanating from a source, the device comprising:

an elongated enclosure positioned to receive the sound wave energy and adapted to translate a portion of a longitudinal component of the sound wave energy into an increased radial component of the sound wave energy; and a wall for the elongated enclosure adapted to absorb a portion of the radial component of the sound wave energy.

* * * * *